US007730838B1

(12) United States Patent
Dupont et al.

(10) Patent No.: US 7,730,838 B1
(45) Date of Patent: Jun. 8, 2010

(54) BUOYANCY DISSIPATER AND METHOD TO DETER AN ERRANT VESSEL

(75) Inventors: James H. Dupont, Bowie, AZ (US); William N. Patterson, Tucson, AZ (US); Richard D. Loehr, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/362,547

(22) Filed: Jan. 30, 2009

(51) Int. Cl.
*F42B 12/02* (2006.01)
*F42B 19/10* (2006.01)
*F42B 15/22* (2006.01)

(52) U.S. Cl. ..... 102/399; 102/381; 114/21.2

(58) Field of Classification Search ..... 102/399, 102/530, 374, 381; 114/316, 317, 318, 21.3, 114/21.2

See application file for complete search history.

(56) References Cited

U.S. PATENT DOCUMENTS

| | | | | | |
|---|---|---|---|---|---|
| 923,922 | A * | 6/1909 | Wratzke | 102/530 |
| 1,222,498 | A * | 4/1917 | Steinmetz | 114/316 |
| 2,289,318 | A * | 7/1942 | Pratt | 102/530 |
| 2,334,211 | A * | 11/1943 | Miller | 422/198 |
| 2,466,561 | A * | 4/1949 | Standal | 102/530 |
| 2,557,815 | A * | 6/1951 | Wheelwright et al. | 43/127 |
| 2,713,308 | A * | 7/1955 | Brown et al. | 102/255 |
| 2,745,369 | A * | 5/1956 | Brown et al. | 114/21.1 |
| 2,779,281 | A * | 1/1957 | Maurice et al. | 102/530 |
| 2,995,088 | A * | 8/1961 | Asplund | 102/202 |
| 3,109,373 | A * | 11/1963 | Saffer, Jr. | 102/399 |
| 3,316,840 | A * | 5/1967 | Grand | 102/367 |
| 3,358,884 | A * | 12/1967 | Link | 222/94 |
| 3,417,719 | A * | 12/1968 | Nitenson | 114/20.1 |
| 4,069,021 | A * | 1/1978 | Schneider | 422/125 |
| 4,249,673 | A * | 2/1981 | Katoh et al. | 222/3 |
| 6,145,459 | A * | 11/2000 | Takahashi et al. | 114/67 A |
| 6,186,085 | B1 * | 2/2001 | Kato et al. | 114/67 A |
| 6,701,819 | B1 * | 3/2004 | Williams et al. | 89/1.81 |
| 6,962,121 | B1 * | 11/2005 | Kuklinski | 114/67 A |
| 7,067,732 | B1 * | 6/2006 | Kuklinski | 114/20.1 |
| 7,185,588 | B2 * | 3/2007 | Clark et al. | 102/530 |
| 2002/0139287 | A1 * | 10/2002 | Chase | 114/294 |
| 2005/0047870 | A1 * | 3/2005 | Rode | 405/129.35 |

* cited by examiner

*Primary Examiner*—Bret Hayes
(74) *Attorney, Agent, or Firm*—Schwegman, Lundberg & Woessner, P.A.; Gregory J. Gorrie

(57) ABSTRACT

Embodiments of a buoyancy dissipater and method for deterring a vessel are generally described herein. In some embodiments, a volume of gas is generated from a propellant and diffused below a waterline of a vessel. The resulting gas bubble dissipates the buoyancy of the vessel providing a non-lethal deterring effect.

15 Claims, 3 Drawing Sheets

BUOYANCY DISSIPATER AND METHOD TO DETER AN ERRANT VESSEL

TECHNICAL FIELD

Embodiments pertain to deterring vessels by buoyancy dissipation.

BACKGROUND

There is presently a need to protect harbors from errant ships, interdict smugglers, and prevent ship-based terrorist actions on the high seas. One issue that law-enforcement officials have is the deterrence of these errant ships. Ships that are posing a threat to a harbor, carrying illegal drugs or weapons, or engaging in some other illicit or illegal activity are difficult to deter without destroying the errant ship or the evidence on board and without inflicting any fatalities.

Thus, there are general needs for apparatus and methods for deterring an errant ship without destruction of the ship and without inflicting fatalities.

DETAILED DESCRIPTION

The following description and the drawings sufficiently illustrate specific embodiments to enable those skilled in the art to practice them. Other embodiments may incorporate structural, logical, electrical, process, and other changes. Examples merely typify possible variations. Individual components and functions are optional unless explicitly required and the sequence of operations may vary. Portions and features of some embodiments may be included in, or substituted for, those of other embodiments. Embodiments set forth in the claims encompass all available equivalents of those claims.

Figure 1:
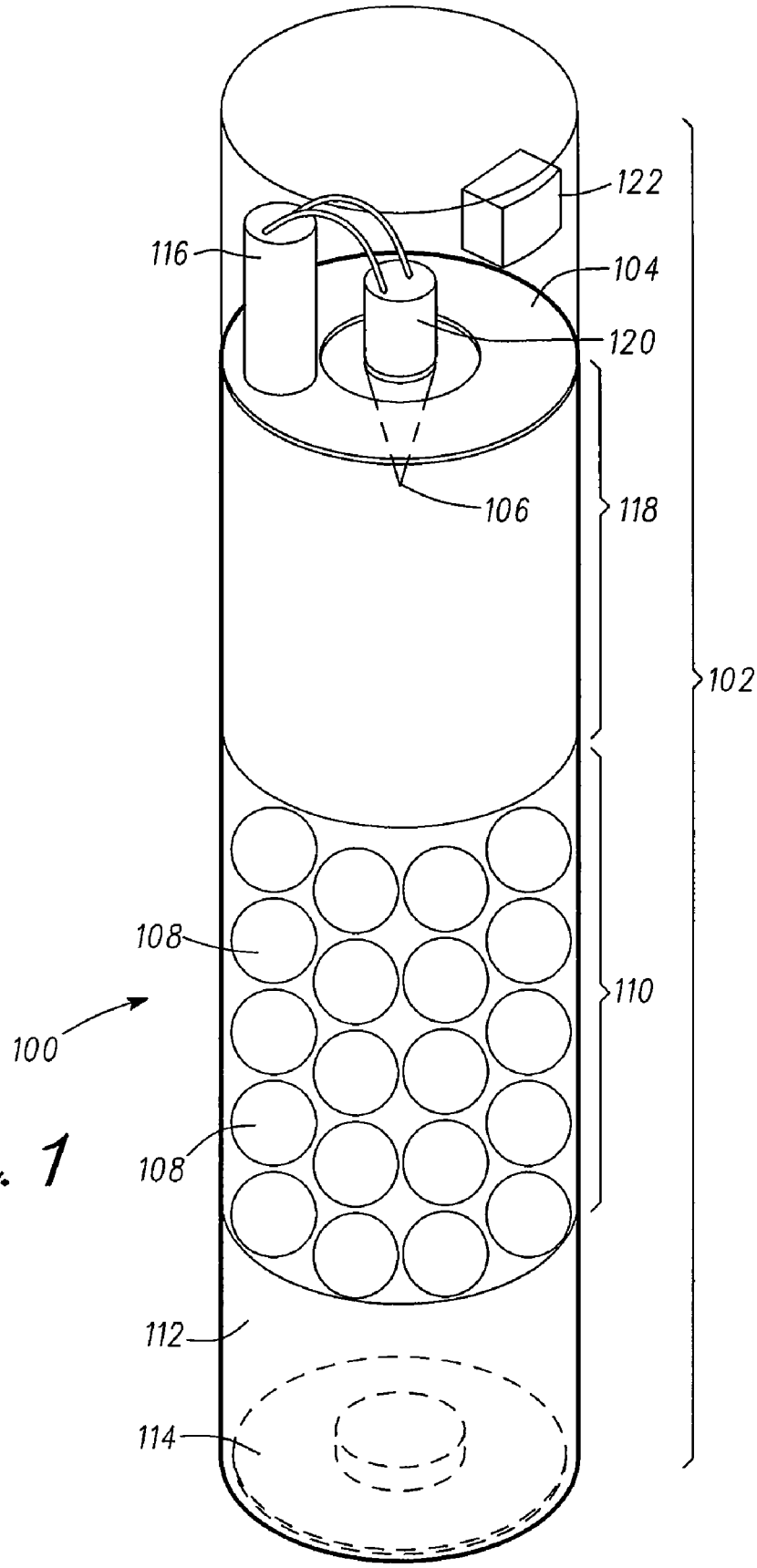
FIG. 1 is a functional diagram of a buoyancy dissipater in accordance with some embodiments.

FIG. 1 is a functional diagram of a buoyancy dissipater in accordance with some embodiments. Buoyancy dissipater 100 generates a volume of gas and diffuses the volume of gas below a waterline of a vessel to dissipate the buoyancy of the vessel. By the generation of a sufficiently large volume of gas and the creation of a gas bubble near or under a vessel, the buoyancy of the vessel is dissipated. Accordingly, buoyancy dissipater 100 provides a non-lethal way to alter or divert and possibly disable an errant vessel's course.

Buoyancy dissipater 100 may include, among other things, delivery shell 102, propellant 104, diffuser 110, ballast 112, fuze 114, energy storage element 116, pressure cylinder 118 and igniter 120. Diffuser may include diffusion ports 108. Buoyancy dissipater 100 may also include control system 122 to control the operations of the various elements. Igniter 120 may include conical element 106 which may contain explosive material for use in igniting propellant 104. Igniter 120 along with propellant 104 may comprise a gas generator for generating a volume of gas.

Figure 2:
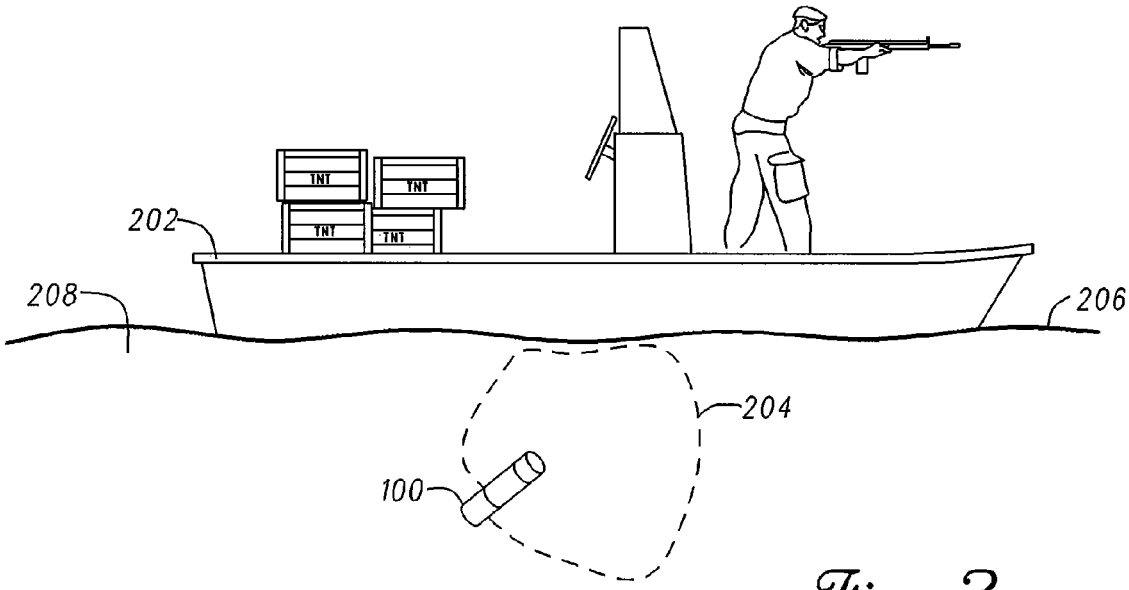
FIG. 2 illustrates the operation of a buoyancy dissipater in accordance with some embodiments.

FIG. 2 illustrates the operation of a buoyancy dissipater in accordance with some embodiments. Buoyancy dissipater 100 generates a volume of gas resulting in gas bubble 204 below waterline 206 of vessel 202. Vessel 202 may be an errant vessel that is posing some type of threat or engaging in some sort of illegal or illicit activity. Gas bubble 204 dissipates the buoyancy of vessel 202. Because gas bubble 204 is significantly more compressed than the volume of water 208 being displaced, the buoyancy of vessel 202 is dissipated or disrupted. In these embodiments, the higher-pressure gas at discharge displaces water until the gas pressure and the water pressure reach equilibrium to create the envelope for gas bubble 204.

Referring to FIGS. 1 and 2 together, in accordance with embodiments, the gas generator may be configured to generate a volume of gas from propellant 104, diffuser 110 may be configured to diffuse the volume of gas below waterline 206 of vessel 202, and igniter 120 may be coupled to the gas generator and configured to ignite propellant 104. Pressure cylinder 118 may provide a region within buoyancy dissipater to allow propellant 104 to burn and rapidly expand after ignition.

Energy storage element 116 may provide energy to igniter 120, as well as provide energy for other elements of buoyancy dissipater 100. Energy storage element 116 may, for example, be a battery or a capacitor.

Ballast 112 may be configured to maintain buoyancy dissipater 100 at a predetermined level below waterline 206. Ballast 112 may comprise a material of a predetermined density, or may be a water ballast. Ballast 112 may be used to assure that buoyancy dissipater 100 is below waterline 206 before propellant 104 is ignited.

Propellant 104 may be an air-bag propellant or gas generant. In some embodiments, propellant 104 may be an oxidizer such as Copper Nitrate ($CuNO_3$ or $Cu(NO_3)_2$) (e.g., in pellet form) or potassium perchlorate ($KCLO_4$) (e.g., in powder form). In some embodiments, propellant 104 may be cast (i.e., poured into a mold and solidified), although the scope of the embodiments is not limited in this respect.

In some embodiments, diffuser 110 may include a plurality of diffusion ports 108 to allow the volume of gas to escape during gas generation and to diffuse the volume of gas. Diffusion ports 108 may comprise holes positioned radially around diffuser 110 to allow the rapidly expanding gas to diffuse radially. The difference in pressure between the higher-pressure gas and lower-pressure water may inhibit water 208 from entering buoyancy dissipater 100. In some embodiments, diffusion ports 108 may include a cover to inhibit water from entering buoyancy dissipater 100. The cover may destruct or come off when the gas is generated.

In some alternate embodiments, diffusion ports 108 comprise one-way diffusion ports located radially around diffuser 110 to allow the expanding gas to diffuse radially. The inclusion of one-way diffusion ports may inhibit water 208 from entering buoyancy dissipater 100.

Fuze 114 may be configured to initiate detonation of propellant 104. Fuze 114 may initiate detonation of propellant 104 when an errant vessel, such as vessel 202, is detected. In some embodiments, fuze 114 may be an impact fuze that may initiate detonation upon impact with waterline 206 and cause propellant 104 to be detonated after a predetermined period of time. Alternatively, fuze 114 may be configured to initiate detonation upon impact with vessel 202. Fuze 114 may also comprise a magnetic fuze that may initiate detonation upon magnetic detection of vessel 202, a timed fuze that may initiate detonation after a predetermined period of time, or a proximity fuze that may initiate detonation based on a predetermined proximity of vessel 202.

Delivery shell 102 may be a lightweight delivery shell configured to contain the components of buoyancy dissipater 100. Delivery shell 102 may comprise lightweight materials such as alloys of aluminum or titanium or may be plastic. In some embodiments, a portion of delivery shell 102 may be configured to rupture or blow during gas generation to allow the large volume of gas to escape and generate gas bubble 204. In these embodiments, diffuser 110 and diffusion ports 108 are not required.

In some embodiments, buoyancy dissipater 100 may be configured to be launched by a gun. In these embodiments, delivery shell 102 and the various components of buoyancy dissipater 100 may be sufficiently hardened to withstand gun launching. In other embodiments, buoyancy dissipater 100 may be missile launched and may include a rocket engine (not illustrated) and guidance system (not illustrated). In other embodiments (not illustrated), buoyancy dissipater 100 may be launched from an air cannon or may be shoulder launched. In some other embodiments, buoyancy dissipater 100 may be attached to a gun-launched projectile. In other embodiments, buoyancy dissipater 100 may comprise an air-dropped canister. In other embodiments, buoyancy dissipater 100 may be operate as a mine and may include sensors (such as fuze 114) configured to activate when a ship, such as vessel 202, passes over or nearby. In some embodiments, buoyancy dissipater 100 may be remotely activated. In some embodiments, buoyancy dissipater 100 may be provided in a torpedo and may be guided to a target, such as vessel 202, by guide wires.

In some embodiments, buoyancy dissipater 100 may be configurable to provide a variable propellant load in which the propellant charge size is selectable to vary an amount of propellant 104 that is ignited. In these embodiments, more than one igniter 120 may be used. The propellant charge size may be selectable by a user to allow selection to be based on a size or tonnage estimate of vessel 202. In these embodiments, a charge size selector may be provided to allow the propellant charge size to be selected by the user. Separate portions of propellant 104 may be ignited to vary the amount of propellant 104 that is ignited and burned to control the amount of gas that is generated by the gas generator. In some embodiments, the user may select a vessel size (e.g., very large, large, medium, or small) and the propellant charge size may be varied accordingly. In these embodiments, buoyancy dissipater 100 may provide a non-lethal deterrent to vessel by allowing the propellant charge size to be properly selected so that vessel 202 is not destroyed.

In some other embodiments, the propellant charge size may be selectably increased to provide a lethal deterrent in which vessel 202 may be destroyed or sunk. In this way, buoyancy dissipater 100 may be configured to capsize an errant vessel that may be loaded, for example, with destructive materials. By varying the amount of propellant 104, buoyancy dissipater 100 is scalable for the various situations that may be encountered in the field.

Figure 3:
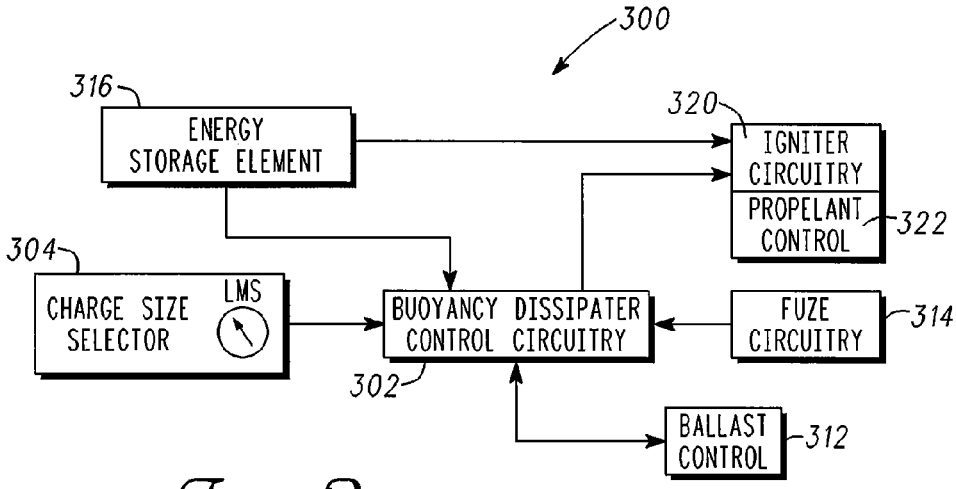
FIG. 3 is a block diagram of a buoyancy dissipater control system in accordance with some embodiments.

FIG. 3 is a block diagram of a buoyancy dissipater control system in accordance with some embodiments. Buoyancy dissipater control system 300 may correspond to control system 122 (FIG. 1) of buoyancy dissipater 100 (FIG. 1) and may be used to control the various operations of buoyancy dissipater 100 (FIG. 1). Buoyancy dissipater control system 300 may include buoyancy dissipater control circuitry 302, charge size selector 304, ballast control element 312, fuze circuitry 314, igniter circuitry 320 and propellant control element 322. Buoyancy dissipater control system 300 may also include energy storage element 316 corresponding to energy storage element 116 (FIG. 1).

Referring to FIGS. 1 through 3, control circuitry 302 may be configured to, among other things, provide an ignition signal to igniter circuitry 320 for igniting propellant 104 with igniter 120. Fuze circuitry 314 may be responsive to fuze 114 to provide a detonation signal to control circuitry 302, which may provide the ignition signal to igniter circuitry 320 to cause igniter 120 to ignite propellant 104. Charge size selector 304 may allow the selection of a propellant charge size by a user, for example, and propellant control element 322 may be responsive to the selection of the propellant charge size. In these embodiments, propellant control element 322 may be responsive to charge size selector 304 to selectably ignite separate portions of propellant 104 to control (e.g., either increase or decrease) the amount of propellant 104 that is ignited and burned. Accordingly, the amount of gas that is generated by the gas generator may be controlled.

In some embodiments, charge size selector 304 may allow a user to select a vessel size (e.g., very large, large, medium, or small) and charge size selector 304 may cause propellant control element 322 to vary the propellant charge size accordingly. In these embodiments, buoyancy dissipater 100 may provide a non-lethal deterrent to vessel 202 by allowing the propellant charge size to be properly selected so that vessel 202 is not destroyed. In some other embodiments, the propellant charge size may be increased to provide a lethal deterrent in which vessel 202 may be destroyed or sunk. By varying the amount of propellant 104, buoyancy dissipater 100 is scalable for various operational situations.

Ballast control element 312 may control ballast 112 in response to signals from control circuitry 302. Ballast control element 312 may be configured to maintain buoyancy dissipater 100 below waterline 206. In some embodiments, ballast control element 312 may be configured to maintain buoyancy dissipater 100 at a predetermined depth below waterline 206.

Although buoyancy dissipater control system 300 is illustrated as having several separate functional elements, one or more of the functional elements may be combined and may be implemented by combinations of software-configured elements, such as processing elements including digital signal processors (DSPs), and/or other hardware elements. In some embodiments, buoyancy dissipater control circuitry 302 may include one or more processing elements.

Figure 4:
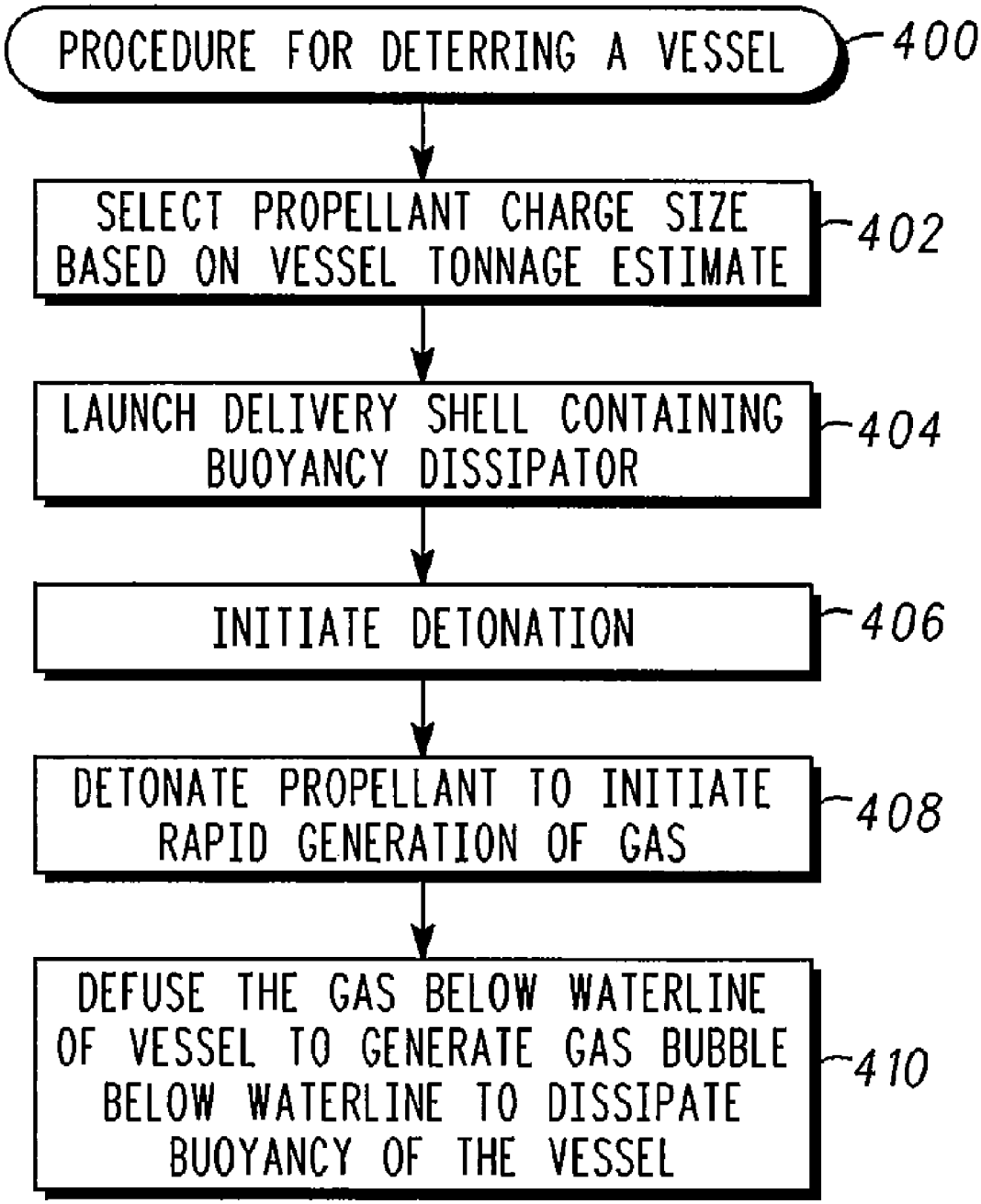
FIG. 4 is a flow chart of a procedure for deterring a vessel in accordance with some embodiments.

FIG. 4 is a flow chart of a procedure for deterring a vessel in accordance with some embodiments. Procedure 400 may be performed by a buoyancy dissipater, such as buoyancy dissipater 100 (FIG. 1), although this is not a requirement.

In operation 402, a propellant charge size may be selected, for example, based on a tonnage estimate of an errant vessel. The selection of the propellant charge size may be performed by a user through the use of charge size selector 304 (FIG. 3).

In operation 404, the delivery shell containing the buoyancy dissipater may be launched toward the errant vessel. In other embodiments discussed above, other techniques to locate the buoyancy dissipater near an errant vessel may be used.

In operation 406, detonation may be initiated by a fuze, such as fuse 114 (FIG. 1). In some embodiments, detonation may be initiated when the delivery shell impacts the water, although this is not a requirement.

In operation 408, the propellant, such as propellant 104 (FIG. 1), may be ignited to initiate the rapid generation of gas. In some embodiments, buoyancy dissipater control system 300 (FIG. 1) may be configured to initiate the rapid generation of gas when buoyancy dissipater 100 (FIG. 1) is near (in close proximity to) or under the errant vessel. In embodiments in which the propellant charge size is selectable, selected portions of propellant may be ignited by separate igniters.

In operation 410, the gas is diffused to generate a gas bubble below the waterline of the vessel to dissipate the buoyancy of the errant vessel. The dissipation of the buoyancy of the errant vessel may provide a non-lethal deterring effect allowing law-enforcement official to more easily intercept the errant vessel.

The Abstract is provided to comply with 27 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A buoyancy dissipater comprising:

propellant;

a gas generator to generate a volume of gas from the propellant;

a diffuser having diffusion ports to radially diffuse the gas generated by the gas generator below a waterline of a vessel to dissipate buoyancy of the vessel;

propellant charge-size control circuitry to control a propellant charge size to change an amount of the propellant that is to be ignited to vary an amount of gas to be generated by the gas generator.

2. The buoyancy dissipater of claim 1 wherein the propellant charge-size control circuitry allows the propellant charge size to be selected by a user based on a size estimate of the vessel.

3. The buoyancy dissipater of claim 1 further comprising a plurality of igniters to control the amount of the propellant that is to be ignited to vary the volume of the gas that is generated, wherein each igniter is to ignite separate portions of the propellant.

4. The buoyancy dissipater of claim 1 wherein the propellant comprises an air-bag generant.

5. The buoyancy dissipater of claim 1 wherein the diffusion ports allow the gas generated by the gas generator to escape during gas generation and diffuse below the waterline.

6. The buoyancy dissipater of claim 5 wherein the diffusion ports comprise holes positioned radially around the diffuser to diffuse the gas radially with respect to the buoyancy dissipater.

7. The buoyancy dissipater of claim 1 further comprising a fuze to initiate detonation of the propellant.

8. A buoyancy dissipater comprising:

propellant;

a fuze to initiate detonation of the propellant;

a gas generator to generate a volume of gas from the propellant;

a diffuser to diffuse the gas generated by the gas generator below a waterline of a vessel to dissipate buoyancy of the vessel;

fuze circuitry responsive to the fuze;

control circuitry to provide an ignition signal to an igniter for igniting the propellant in response to an indication from the fuze circuitry;

a charge size selector to allow selection of a propellant charge size by a user; and a propellant control element responsive to the selection of the propellant charge size to control an amount of propellant to be ignited, wherein the selection of the propellant charge size varies the volume of the gas that is generated.

9. The buoyancy dissipater of claim 8 further comprising a delivery shell to contain the buoyancy dissipater.

10. The buoyancy dissipater of claim 9 wherein the delivery shell is gun-launched.

11. An errant-vessel deterring apparatus comprising:

a gas generator including an igniter to ignite a propellant to generate a volume of gas;

a diffuser comprising a plurality of diffusion ports to diffuse the volume of gas below a waterline of a vessel to dissipate buoyancy of the vessel;

a pressure cylinder to provide a region within the buoyancy dissipater to allow the propellant to burn and expand after ignition;

ballast to maintain the buoyancy dissipater below the waterline;

a fuze to initiate detonation of the propellant;

a delivery shell to contain the gas generator, the diffuser, the pressure cylinder, the ballast and the fuze; and propellant charge-size selection control circuitry to allow a propellant charge size to be selectable by a user based on a size estimate of the vessel, wherein the delivery shell is gun-launched toward the vessel, and wherein the fuze initiates detonation upon impact of the delivery shell with the waterline for detonation of the propellant after a predetermined period of time or upon detection of the vessel.

12. The apparatus of claim 11 wherein the diffusion ports comprise holes positioned radially around the diffuser to allow the gas to diffuse radially, and wherein the propellant comprises an air-bag generant.

13. A method for deterring a vessel with a buoyancy dissipater, the method comprising:

selecting a propellant charge size based on a size estimate of the vessel;

initiating a rapid generation of gas by igniting a propellant; and radially diffusing the gas below a waterline of the vessel to generate a gas bubble to dissipate the buoyancy of the vessel, wherein selecting the propellant charge size varies a volume of the gas that is generated.

14. The method of claim 13 further comprising:

launching a delivery shell from above the waterline of the vessel, the delivery shell containing the buoyancy dissipater, the buoyancy dissipater to travel below the waterline toward the vessel;

initiating detonation upon impact of the delivery shell with the waterline; and igniting the propellant after a predetermined period of time after impact with the waterline or upon detection of the vessel.

15. A method for deterring a vessel with a buoyancy dissipater, the method comprising:

launching a delivery shell from above a waterline of the vessel, the buoyancy dissipater to travel below the waterline toward the vessel;

initiating detonation upon impact of the delivery shell with the waterline;

igniting a propellant after a predetermined period of time after impact with the waterline or upon detection of the vessel to initiate a rapid generation of gas;

diffusing the gas below the waterline of the vessel to generate a gas bubble to dissipate buoyancy of the vessel; and providing for user selection of a propellant charge size based on a size estimate of the vessel, wherein the selection of the propellant charge size varies a volume of the gas that is generated.

* * * * *